US005759015A

United States Patent [19]

Van Lintel et al.

[11] Patent Number: 5,759,015

[45] Date of Patent: Jun. 2, 1998

[54] PIEZOELECTRIC MICROPUMP HAVING ACTUATION ELECTRODES AND STOPPER MEMBERS

[75] Inventors: Harald Van Lintel; Patrick Poscio; Frédéric Neftel, all of Lausanne, Switzerland

[73] Assignee: Westonbridge International Limited, Dublin, Ireland

[21] Appl. No.: 640,797

[22] PCT Filed: Dec. 21, 1994

[86] PCT No.: PCT/IB94/00435

§ 371 Date: Jun. 5, 1996

§ 102(e) Date: Jun. 5, 1996

[87] PCT Pub. No.: WO95/18307

PCT Pub. Date: Jul. 6, 1995

[30] Foreign Application Priority Data

Dec. 28, 1993 [CH] Switzerland ..... 3878/93

[51] Int. Cl.[6] ..... F04B 17/00

[52] U.S. Cl. ..... 417/322; 417/413.2; 417/413.3; 92/13.2

[58] Field of Search ..... 417/413.1, 413.2, 417/413.3, 322; 92/13.2

[56] References Cited

U.S. PATENT DOCUMENTS

| | | | |
|---|---|---|---|
| 417,035 | 12/1889 | Hyatt | 92/13.2 |
| 1,183,486 | 5/1916 | Pardue | 92/13.2 |
| 5,085,562 | 2/1992 | Van Lintel | 417/413.3 |
| 5,171,132 | 12/1992 | Miyazaki et al. | 417/413.1 |
| 5,271,724 | 12/1993 | Van Lintel | 417/413.3 |

FOREIGN PATENT DOCUMENTS

| | | | |
|---|---|---|---|
| 0 392 978 | 10/1990 | European Pat. Off. . | |
| 0 435 653 | 7/1991 | European Pat. Off. . | |
| 1177065 | 4/1959 | France | 92/13.2 |
| 60-159387 | 8/1985 | Japan . | |
| WO 92/04569 | 3/1992 | WIPO . | |

OTHER PUBLICATIONS

H.T.G. Van Lintel, "A Piezoelectric Micropump Based on Micromachining of Silicon", Sensors and Actuators, 1988, vol. 15, pp. 153–167, Elsevier Sequoia/Printed in the Netherlands.

*Primary Examiner*—Roland McAndrews
*Attorney, Agent, or Firm*—Young & Thompson

[57] ABSTRACT

A micropump including two glass sheets (2, 8) with a machined silicon board (6) sealingly inserted therebetween. An inlet valve (12), a pumping chamber (50) and an outlet valve (28) are arranged between an inlet (10) and an outlet (4). A pump diaphragm (56) forming one wall of the pumping chamber comprises a thickened central portion (58) interacting with the upper sheet (8) to form an abutment restricting the suction movement of the diaphragm (50), and lower abutment elements (60) restricting the movement of the diaphragm when the fluid is discharged. A piezoelectric pad (72) engages the diaphragm by means of an intermediate part (84) to perform the pumping movement between upper and lower limits precisely defined by the abutments. A precisely defined and constant flow rate is thus achieved regardless of changes in the performance of the piezoelectric pad.

15 Claims, 4 Drawing Sheets

PIEZOELECTRIC MICROPUMP HAVING ACTUATION ELECTRODES AND STOPPER MEMBERS

BACKGROUND OF THE INVENTION

The present invention is concerned with a micropump including at least one base plate, at least one upper plate and one intermediate plate sandwiched between the two other plates and made of a material which can be machined so as to define a pumping chamber, at least one control member for the inflow of the fluid to connect the pumping chamber with at least one inlet to the micropump and at least one control member for the outflow of the fluid to connect the pumping chamber with at least one outlet of the micropump, the pumping chamber including a movable wall which is machined in the intermediate plate and which can be displaced in two opposite directions during the suction of a fluid from the inlet to the pumping chamber or during the expelling of this fluid from the pumping chamber to the outlet, actuating means being provided to move said movable wall to cause a periodic variation of the volume of the pumping chamber.

Such pumps can be used in particular for the in situ administration of medicinal drugs, the miniaturization of the pump allowing a patient to carry the same on his body, or even to have the pump implanted directly in the body. Furthermore, such pumps allow the administration by injection of small metered amounts of fluid.

In an article entitled "A piezoelectric micropump based on micro-machining of silicon"published in "Sensors and"Actuators" N15 (1988), pages 153 to 167, H. Van Lintel et al. give the description of two embodiments of a micropump, including each a superposition of three plates, namely of a machined silicon plate placed between two glass plates.

The silicon plate is etched to form a cavity, which, with one of the glass plates, defines the pumping chamber, an inflow or suction valve and at least one outflow or expelling valve, allowing the pumping chamber to communicate respectively with an inflow channel and an outflow channel. The part of the plate forming a wall of the pumping chamber can be deformed by a control member provided for example as a piezoelectric chip or crystal. The same is equipped with two electrodes which, when they are connected to a source of voltage, cause the deformation of the chip and, consequently, the deformation of the plate, which causes a variation of the volume of the pumping chamber. This movable or deformable wall of the pumping chamber can thus be moved between two positions.

The functioning of the micropump is as follows. When no voltage is applied to the piezoelectric chip, the inlet and outlet valves are in their closed position. When a voltage is applied, an increase of the pressure inside the pumping chamber occurs, which causes the opening of the outlet valve. The fluid contained in the pumping chamber is then expelled through the outflow channel by the displacement of the deformable wall from a first position towards a second position. During this phase, the inlet valve is maintained closed by the pressure prevailing in the pumping chamber.

Conversely, when the voltage is decreased, the pressure in the pumping chamber decreases. This causes the closing of the outlet valve and the opening of the inlet valve. The fluid is then sucked into the pumping chamber through the inflow channel, owing to the displacement of the deformable wall from the second position to the first position.

As already mentioned, these micropumps are used in particular for the administration of medicinal drugs. It is therefore important that the flow rate of the micropump be well defined, so that the medicinal drug injected be metered very precisely. However, known micropumps suffer in this respect, from certain imperfections.

In actual fact, the flow rate of the micropump depends on the variation of the volume of the pumping chamber between the two positions of the deformable wall. This variation of the volume depends on several parameters, among which the voltage applied to the piezoelectric chip and the physical characteristics of the piezoelectric chip (thickness, diameter, dielectric constant) and of the deformable wall (material, thickness). Thus, the same voltage applied to micropumps apparently identical may cause differing deformations of the pumping chamber of these micropumps, which, subsequently, will produce differing flow rates.

Furthermore, for a given micropump, the flow rate can drift in the course of time due to aging of the materials from which the piezoelectric chip is made and the aging of the adhesive used for its bonding. Finally, the flow rate of the micropump depends on the pressure in the outflow and inflow channels.

H. Van Lintel et al. have described in the above-mentioned article a micropump provided with an additional valve, which makes it possible to render the flow rate less dependent on the pressure in the outflow channel. However, this micropump cannot solve the other drawbacks mentioned above.

The invention is aimed at remedy-ing to the drawbacks mentioned and at obtaining a micropump having a flow rate which is very accurate and constant, while being independent of the variations in the performance and of the aging of the driving member and also of the pressures in the inflow and outflow conduits.

To this end, the invention is characterized in that the micropump includes first and second stopper members arranged in such a manner as to limit the amplitude of the movement of the movable wall in said two opposite directions, with the first stopper members limiting this movement during the sucking of the fluid inside the pumping chamber and the second stopper members limiting this movement during the expelling of fluid from the pumping chamber.

By limiting the amplitude of the movement in the two opposite directions, the volume of the substance pumped at each alternate movement of the movable pumping wall or membrane is clearly defined and remains constant. It is not dependent on the variations in the performance of the driving member, which is preferably a piezoelectric chip. Neither aging nor any other deterioration of this piezoelectric chip will have any influence on the flow rate of the pumped substance. It is therefore not necessary to provide a circuit for correcting the performance of the micropump in the course of time.

A calibration of the micropump to take into account variations in performance of the piezoelectric chip used is not deemed necessary either.

The flow rate of the substance being pumped is also substantially independent of the pressure prevailing in the inflow and in the out-flow conduits. It only depends on the machining of the micropump and on the frequency of the pumping.

According to an advantageous embodiment, the movable wall includes a central rigid part which is surrounded by a resilient edge of a lesser thickness integral with the central rigid part, with the latter protruding from the face of the movable wall directed away from the pumping chamber and being designed for coming in contact with the plate which is positioned facing it, thus providing said first stopper members limiting the movement of the movable wall during the suction of the fluid.

The central rigid part of the movable wall ensures an accurate displacement of this wall, which is comparable to the movement of a piston. Pressure differences in the pumping chamber will cause only a small change in the volume, owing to the smaller surface of the resilient edge surrounding the rigid central part.

According to a preferred embodiment, the actuator means include a driving member mounted movably on either the base plate or the upper plate and an intermediate part placed between the movable wall and the driving member.

Advantageously, the driving member is mounted movably on the outer face of said upper plate, said intermediate part extending through the upper plate via an opening.

Considering that the driving member, preferably a piezoelectric chip, is not bonded directly to the membrane, variations in the shape and in the deformation of the piezoelectric chip have no influence on the shape of the deformable wall, and accordingly on the flow rate.

In an advantageous embodiment, the movable wall consists of a membrane having a central part protruding in such a manner as to provide together with the upper plate said first stopper members, this central part being surrounded by a piezoelectric member bonded to the membrane and exhibiting a central bore for allowing the passage of the central part.

This arrangement provides a construction which is simple, while constraining the movements of the deformable wall in both directions.

Finally, according to another favourable version, the first stopper members are provided as an adjustable screw extending through the upper plate and of which one end is positioned against the movable wall.

In this type of micropump, the volume of the substance pumped at each alternating movement of the movable wall and hence the flow rate can be adjusted by acting on one of the stopper members provided as a screw.

Other advantages will become apparent from the characteristic features set out in the dependant claims and from the detailed description made hereafter of the invention, with reference to drawings which illustrate schematically and by way of example three embodiments of the invention and one alternate version of the first embodiment.

DETAILED DESCRIPTION OF THE DRAWINGS

DETAILED DESCRIPTION OF THE INVENTION

Figure 1:
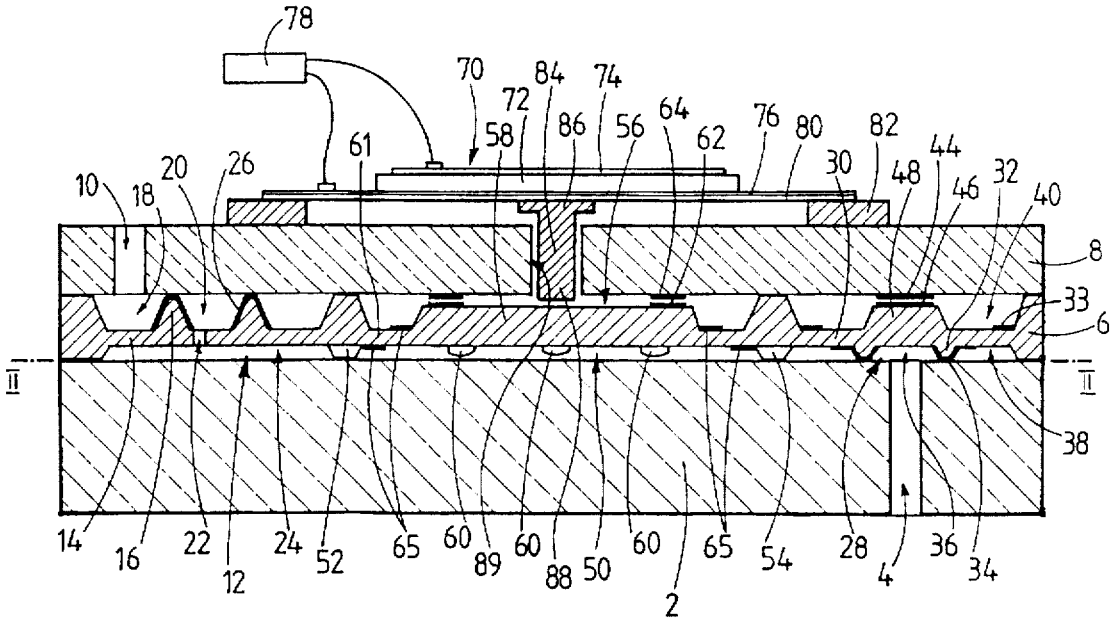
FIG. 1 is a cross-sectional view of a first embodiment of the invention taken along line I—I of FIG. 2.

In these figures, a same component, when shown in several figures, is indicated on each one of them by the same reference numeral. In the embodiments which will be described, the micropump is equipped with an inlet valve and an outlet valve. One should note however, that the invention is also applicable to micropumps having several valves positioned between the inlet and the pumping chamber and/or several valves positioned between the pumping chamber and the outlet. The micropump can also be provided with a plurality of inlets and a plurality of outlets. The inlet and the outlet valves could be replaced by any other means for controlling the inflow and the outflow of fluid, such as flow rate limiting devices.

It should be noted that, for sake of clarity, the thickness of the different constituent plates of the micropump has been strongly exaggerated in the drawings.

Figure 2:
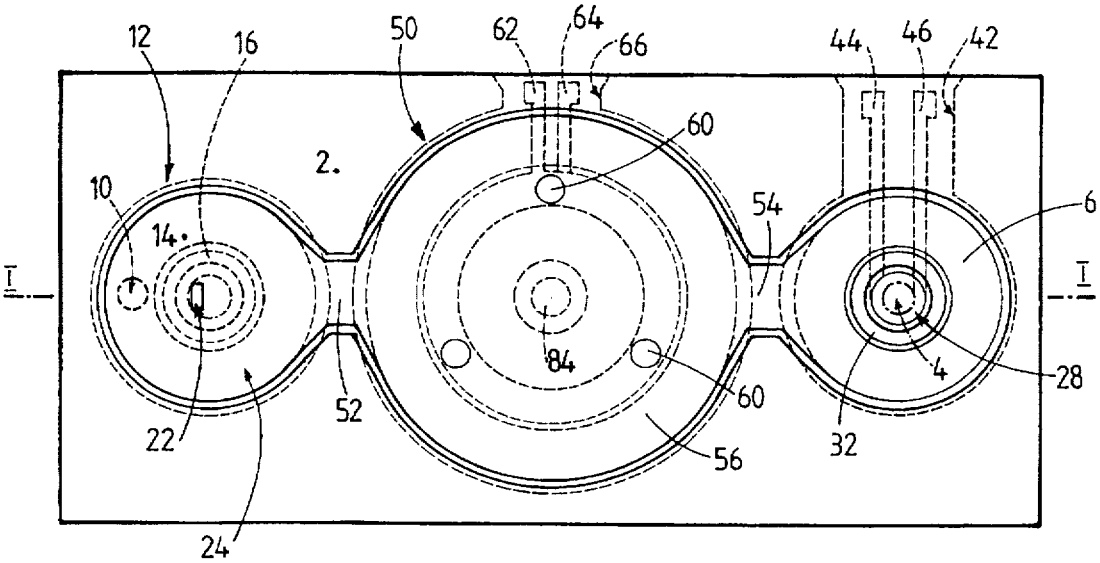
FIG. 2 is a cross-sectional view taken horizontally along line II—II of FIG. 1.

With reference to FIGS. 1 and 2, the micropump according to the first embodiment includes a base plate 2, made preferably of glass. This base plate 2 has a channel 4 extending through it, to provide the outflow conduit of the pump. This conduit can be, for example, connected to an injection needle (not illustrated).

The base plate 2 carries on its upper side an intermediate plate 6 made of silicon or some other material which can be machined using photolithographic techniques. It can be bonded to the base plate 2 by known bonding techniques, such as the technique known as "anodic bonding" or "anodic welding" which involves the heating to a temperature of about 300° C. and the application of a difference of potential of about 500 V between the plates.

An upper plate 8, preferably made of glass, is bonded by the same techniques to the intermediate plate 6. This plate has an inflow channel 10 extending though it, which can be connected to a reservoir (not illustrated) containing a liquid substance to be supplied, for example a medicinal drug which needs to be administered in accurately metered amounts. In this application, the micropump can be carried on the body of the patient or it can even be implanted.

By way of example, the intermediate plate 6, which is made of silicon, can have a crystalline structure of the <100> type, which is favor-able for the successful application of etching techniques. Preferably, the plates 2, 6 and 8 are then carefully polished. These plates 2, 6 and 8 are then advantageously made hydrophilic, in particular when the substance used in the micropump is an aqueous solution. To this end, the silicon plate 6 can be dipped into boiling $HNO_3$.

As an indication, the thickness of the plates 2, 6 and 8 can amount respectively to about 1 mm, 0.3 mm and 0.8 mm, for the case of the plates having a size in the order of 10 mm by 20 mm.

The inflow or sucking conduit 10 and the outflow or expelling conduit 4 are principally connected to a first inlet valve 12, a pumping chamber 50 and a second outlet valve 28.

The first valve 12 of the nonreturn type is machined in the silicon plate 6 and is comprised of a membrane 14 of a generally circular shape carrying an annular rib 16. This rib separates from each other two compartments 18, 20 located above the membrane 14 and cooperates to this end with the lower surface of the upper plate 8.

The first compartment 18 has an annular shape and communicates with the inflow conduit 10. The second compartment 20 has a substantially central position and communicates via a slightly off-centered orifice 22 with a third compartment 24 situated beneath the membrane 14.

The rib 16 is coated with a thin oxide layer 26, also obtained by photolithographic techniques, and the membrane 14 is thereby prestressed or pretensioned, to bias the ridge of the rim 16 against the upper glass plate 8, which acts as a valve seat.

Clearly, other types of known valves or of flow limiting devices can be used instead of the valve described here.

The outlet valve 28 is also machined in the silicon plate 6 and includes a membrane 30 carrying an annular rib 32 coated with an oxide layer 34 which prestresses the membrane 30 to bias the ridge of the rib 32 against the lower plate 2, which acts as the valve seat. Oxide layers 33 applied to the other side of the membrane 33 increase this prestressing.

The rib 32 defines a fourth compartment 36 communicating with the outflow conduit 4 and a fifth compartment 38 external to the rib having a substantially annular shape. A sixth compartment 40 is situated above the membrane 30 and communicates with the outside of the pump via an opening 42. Electrical contacts or electrodes 44, 46 are provided facing each other on the upper plate 8 and on a protruding part 48 of the membrane 30. These contacts make it possible to control adequately the expelling of the fluid. It is clear that other known types of valves or further flow rate limiting devices could replace the outlet valve 28.

The pumping chamber 50 is of a substantially circular shape and is connected by two passages 52 and 54 on the one hand, to the third compartment 24 of the first valve 12 and on the other hand to the fifth compartment 38 of the second valve 28. The pumping membrane 56 providing a movable or a deformable wall of the pumping chamber 50 is made by machining the silicon plate 6 and has a central rigid part 58 which is relatively large by comparison with the total width of the pumping membrane 56. The diameter of this central part 58 varies between 20% and 90% of the diameter of the pumping membrane 56, and preferably between 50% and 80%. This central rigid part 58 has a thickness which is substantially greater than that of the annular edge 61 of the pumping membrane. As an indication, the edge 61 exhibits a thickness between 10 and 100 μm, whereas the central rigid part 58 exhibits a thickness which is lower by 10 to 50 μm than the total thickness of the plate 6. This amounts to a total thickness of, for example, 300 μm.

The pumping membrane 56 carries on its lower surface facing the base plate 2, stopper members 60, of which there may be, for example, three. These stopper members 60 protrude from the lower surface of the membrane and can consist of a silicon oxide layer. They are designed for coming in contact with the upper surface of the base plate 2, to limit the movement of the pumping membrane 56 when expelling or pushing out the fluid. Similarly, the central rigid part 56 of an increased thickness is designed for coming in contact with the upper plate 8 when the pumping membrane 56 is actuated, to provide stopper members opposite the stopper members 60, so as to limit the movement of the pumping membrane 56 when sucking the fluid. Thus, the movement of the pumping membrane is controlled by mechanical means, both on the upper side and on the lower side. This makes it possible to achieve a very precise delivery of the substance being pumped at each alternating movement of the membrane. The central rigid part 56 can be compared to a piston having a well defined travel distance. Since the annular edge 61 of the pumping membrane 56 exhibits a surface which is relatively small by comparison with the total surface of the pumping membrane 56, differences in the pressure in the pumping chamber 50 produce in small changes in the volume beneath the pumping membrane 56.

Furthermore, the stopper members 60 made of oxide prevents any adhesion, for example by a suction effect, of the pumping membrane 56, when the latter moves upwards from its lowermost position.

Electrical contacts or electrodes 62, 64 are placed facing each other on the central rigid part 58 and on the lower surface of the upper layer 8. These contacts 62, 64 extend outside of the pump via an opening 66 and they are connected to an electric circuit (not illustrated) which makes it possible to control the operations of the pumping membrane 56 and the sucking of the fluid. Suitable circuits are described, for example, in the European Patent Application N 0.498.863. In the embodiment described, the electrical contacts themselves act as the stopper members, limiting the movement of the pumping membrane 56 during suction.

The latter furthermore has on both sides areas 65 coated with silicon oxide. These oxide coated areas 65 confer to the membrane a certain level of prestressing (not illustrated) directed upwards in FIG. 1.

An actuating device 70 of the pumping membrane 56 includes a driving member provided as a piezoelectric chip 72 carrying electrodes 74, 76 connected to a generator 78 designed for supplying an alternating voltage. This chip can be that sold by the firm Philips under the reference PXE-52. The chip is bonded by any appropriate means such as an adhesive or by welding, on a resilient blade 80 made of metal, silicon or a plastic material. This blade 80 is mounted via a spacer member 82 on the upper plate 8. This spacer member 82 can be a washer made of a plastic material, of metal or silicon. This spacer member can also be a layer of adhesive of a predetermined thickness or may be a protrusion integral with the glass plate 8. When bonding the resilient blade 80 to the upper plate 8, a stress can be applied to the electrodes of the piezoelectric chip 72 in such a manner that the latter is curved downwards in the direction of the upper plate 8 during the hardening of the adhesive. An intermediate part 84 having the shape of a drawing pin can be bonded via its flat head 86, using any appropriate means such as an adhesive or by welding, to the resilient blade 82. This part acts on the central rigid part 58 of the pumping membrane 56 by its central vertical rod 88 extending through the upper plate via a bore 89. Furthermore, there can be a small clearance between the vertical rod 88 and the pumping membrane 56, when the pump is not operating. This clearance or a certain mechanical stress between the rod 88 and the pumping membrane 56 can be determined by the curvature imparted when hardening the adhesive.

The actuator device 70 including a piezoelectric chip 72 and a resilient blade 80 can also be replaced by a device including two or more piezoelectric plates bonded together or by a device combining piezokeramic and metallic disks.

Thus, the piezoelectric chip 72 is independent of the pumping membrane 56. Hysteresis effects in the piezoelectric chip 72 ("piezocreep") or variations or deteriorations to this chip have no influence on the shape of the pumping membrane 56, owing to the fact that the latter is independent of the piezoelectric chip 72 and is set into motion by means of the intermediate part 84. This construction makes it possible to obtain the displacement of a large volume of fluid for a given diameter of the pumping membrane, owing to the fact that the rigid central part 58 acts in the manner of a piston. The machined parts of the micropump can be further miniaturized while retaining an actuator device of a size which can be selected freely and be of a relatively large size. This miniaturization of the machined parts makes it possible to decrease manufacturing costs.

The general mode of operation of this pump is substantially similar to that described in the article by H. Van Lintel ar al. entitled "A piezoelectric micropump based on micromachining of silicon", published in "Sensors and Actuators" No. 15 (1988.) pages 153 to 167.

Accordingly, when compared to this known type of micropump, the micropump according to the present invention makes it possible to achieve a very accurate administration at each alternating movement. This administration is practically independent of the pressure prevailing in the inflow and in the outflow conduits and is also practically independent of the performance of the piezoelectric chip and of the deterioration and of the hysteresis phenomena known for this type of actuator devices. Furthermore, the movement of the pumping membrane is controlled accurately both by the intermediate rigid part 58 and by the stopper members 60. The flow rate is therefore defined by the machining characteristics of the pumping membrane 56 and by the frequency of the actuator device.

This type of pump makes it possible to use piezoelectric chips exhibiting relatively large fluctuations in their characteristics. Furthermore, it is not necessary to calibrate the pumps for each chip used.

Owing to the fact that the chip is bonded externally, the chip can be easily replaced in case of malfunction.

Up to a certain frequency of the pumping, the flow rate is independent of the viscosity. Owing to the central rigid part and to the electrical contacts 62, 64, it is possible to detect the end of the suction of the fluid and thus obtain additional information concerning the functioning of the micropump.

It should be made clear that the embodiment illustrated above does not limit the invention in any manner, and that it can receive a variety of desirable modifications within the scope defined in claim 1. In particular, the arrangement of the valves and of the inflow and the outflow conduits, as well as that of the pumping chamber could be quite different. The disposition of the areas carrying the oxide can be selected according to the prestressing desired for the valves and the pumping. The actuator device could be provided with a driving means of a type other than a piezoelectric chip.

The intermediate part 84 can be made integral with the resilient blade 80 or further with the piezoelectric chip. It can also be positioned loosely between the resilient blade and the pumping membrane.

The stopper members 60 proper could be done away with. The pumping chamber would then have a small height, such that the upper surface of the base plate 2 would act as a stopper against which the pumping membrane 56 would abut at each alternating movement. The control electrodes 44, 46 and/or 62, 64 could be formed differently or be done away with in a simplified version.

Figure 7:
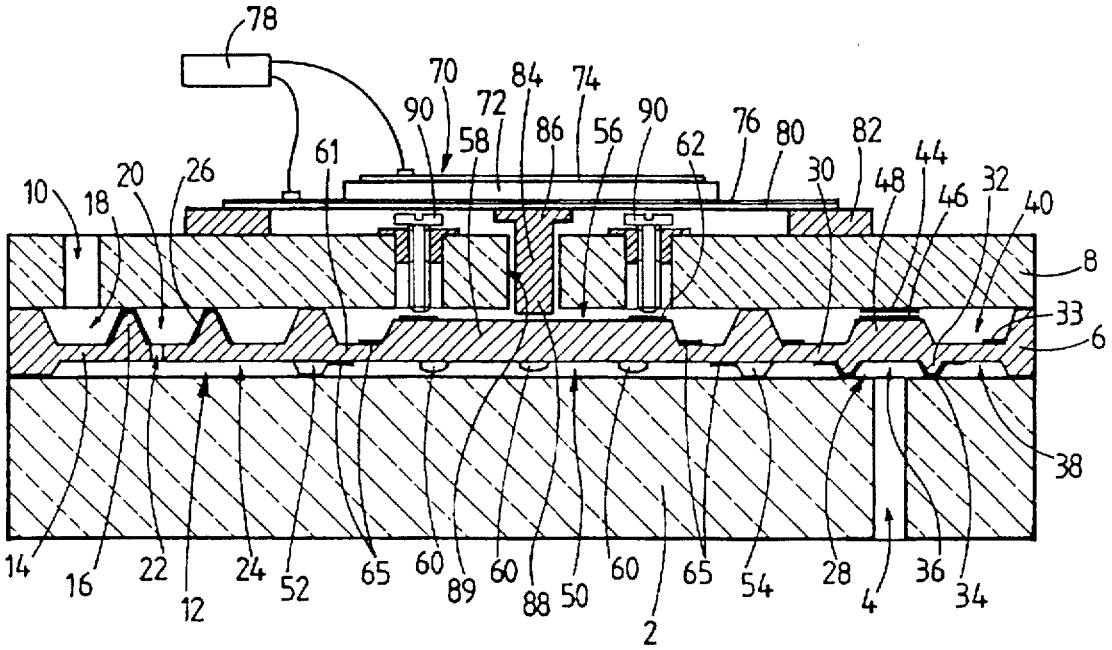
FIG. 7 illustrates an alternate version of the first embodiment.

In accordance with FIG. 7, the pump could furthermore exhibit one or several screws 90 extending through the plate 8 to cooperate at their ends with the central rigid part 58 or with the electrical contact 62. These screws 90 thus provide stopper members which can be used for adjusting the amplitude of the movement during suction. The contact 64 of FIG. 1 will then be replaced by the screw 90 made of a metal material.

Adjustment screws could also be mounted on the blade 80. Furthermore, it would be possible to mount adjustment screws in the flat head 86 of the intermediate part.

Figure 3:
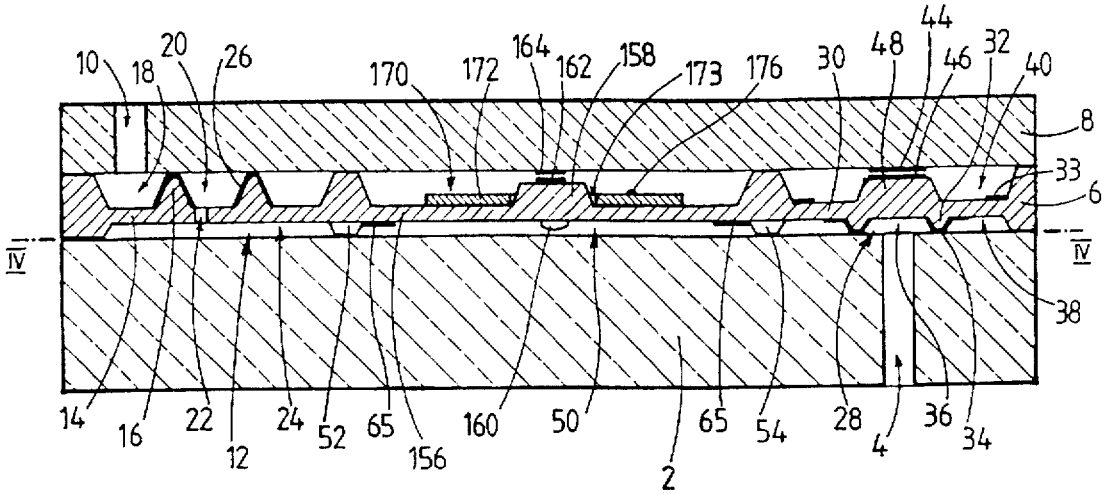
FIG. 3 is a cross-sectional view of a second embodiment of the invention taken along line IV—IV of FIG. 4.
Figure 4:
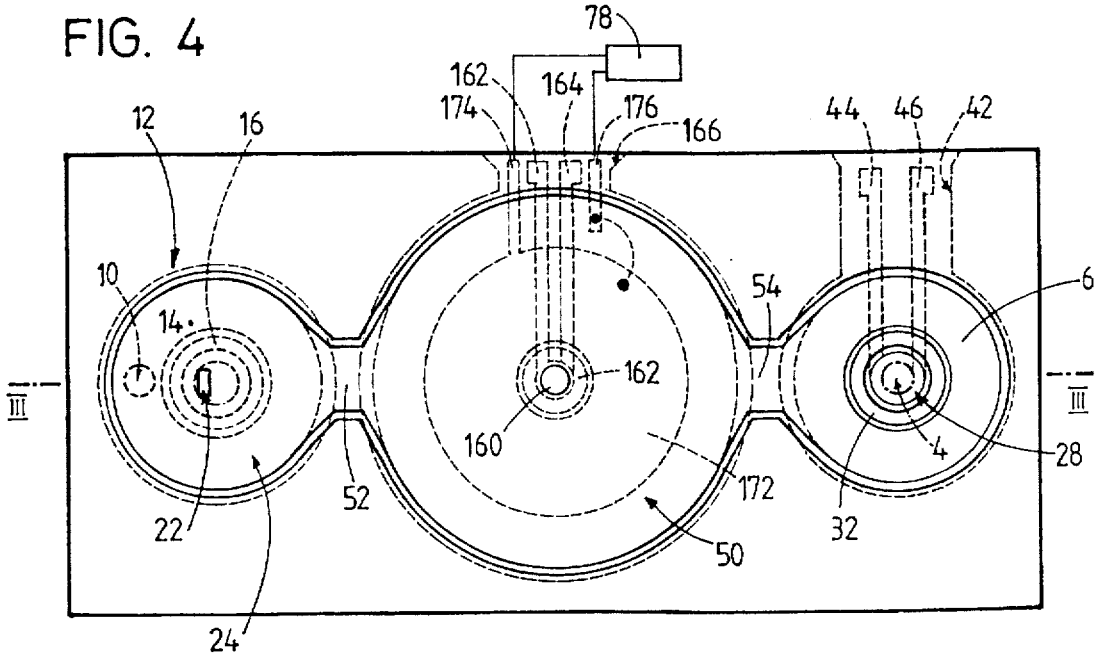
FIG. 4 is a cross-sectional view taken horizontally along line III—III of FIG. 3.

The second embodiment illustrated in FIGS. 3 and 4 differs from the first embodiment only by the construction of the pumping chamber and of the actuator device. Accordingly, components which are similar in the two embodiments carry the same reference numerals and will therefore not be described in any further detail.

This second embodiment also includes a base plate 2 and an upper plate 8 having respectively an inflow conduit 10 and an outflow conduit 4 bored therethrough. Between these two plates 2 and 8, is sandwiched an intermediate plate 6 made of silicon machined by photo-lithographic techniques to form an inlet valve 12, an outlet valve 28 and a pumping chamber 50.

Thin oxide layers 25, 33, 34 make it possible to achieve a predetermined prestressing within the silicon membrane.

The pumping chamber 50 is of a shape which is substantially circular and which is connected by two passages 52 and 54 to the inlet and the outlet valves. The pumping membrane 156, which is machined in the silicon plate 6, is a movable (deformable) wall including a central rigid part 158 which is thicker, to form a stopper member designed for cooperating with the lower surface of the upper plate 8, so as to limit the movement of the pumping membrane 156 during suction. The latter has on its lower surface a lower central stopper member 160. Preferably, this member limiting the movement of the membrane during the expelling is provided as a silicon protrusion of a small height or as a layer of silicon oxide. Thus, the movement of the pumping membrane 156 is arrested in a precise position on both sides, i. e. when moving upwards or downwards. This makes it possible to achieve a precise delivery of the substance administered at each alternating movement of the pumping membrane.

The actuator device 170 is provided as a piezoelectric chip 172 having a central bore 173. The chip is bonded by welding or by an adhesive to the pumping membrane 156. Electrical contacts 174, 176 make it possible to connect the chip to a generator 78 designed for supplying an alternating voltage.

The electrodes 162, 164 are arranged facing each other, on the central part 158 and on the lower surface of the upper plate 8. These electrodes extend outside the pump through an opening 166 and they make it possible to control the suction of the fluid and the functioning of the pumping membrane 156. Furthermore, the latter can be provided with areas carrying silicon oxide 65 for introducing a certain amount of prestressing into the silicon membrane.

The stopper members 160 and 158 having this construction, limit accurately the movement of the pumping membrane 156 in both opposite directions and also allow an accurate delivery of the substance administered at each alternating movement. The flow rate depends solely on the machining characteristics of the pumping membrane and the frequency of the actuator device. Variations or deteriorations in the performance of the piezoelectric chip within certain limits have no influence on the flow rate of the micropump. Accordingly, it is not necessary to calibrate the micropump, an accurate assembling is sufficient. The construction of this embodiment is simpler than that of the first embodiment.

Figure 5:
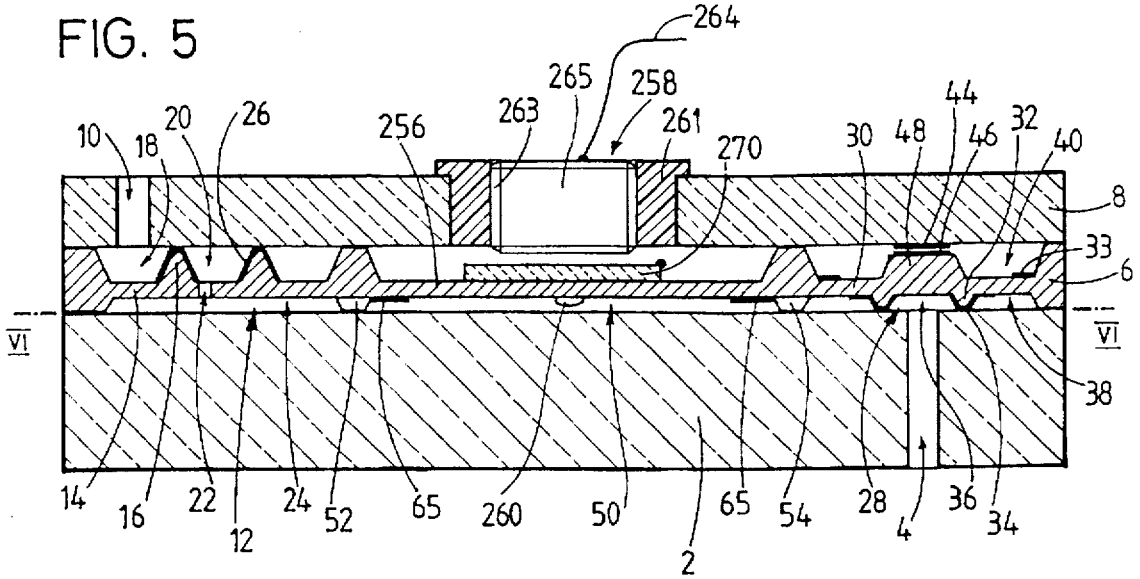
FIG. 5 is a cross-sectional view of a third embodiment of the invention taken along line V—V of FIG. 6.
Figure 6:
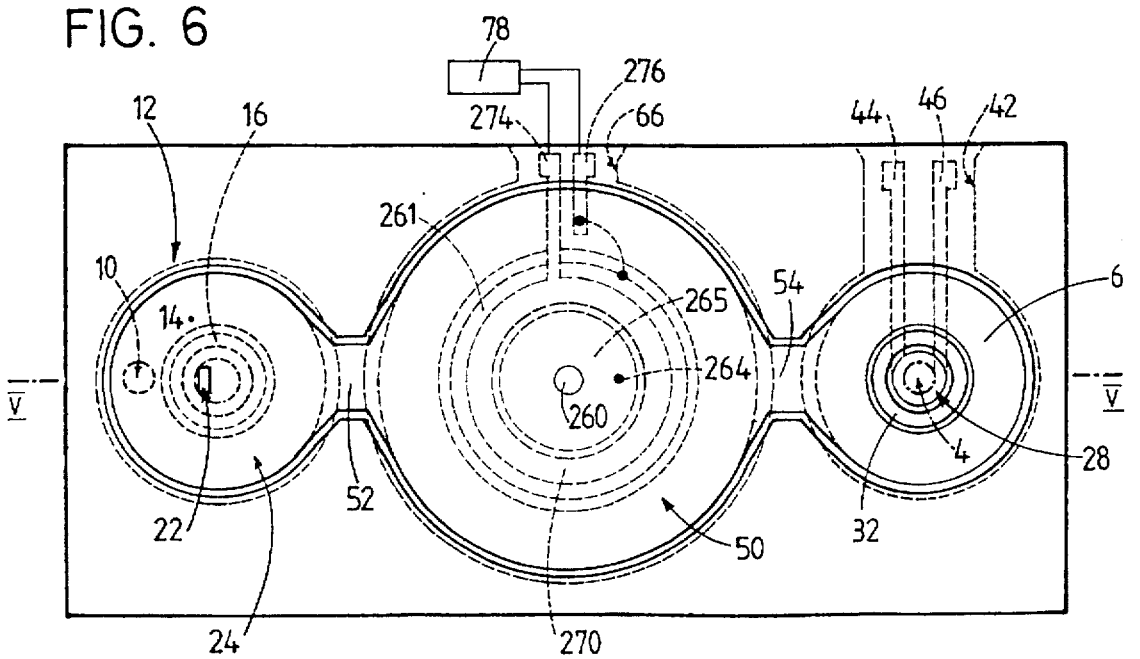
FIG. 6 is a cross-sectional view taken horizontally along line VI—VI of FIG. 5.

The third embodiment illustrated in FIGS. 5 and 6 also differs from the first and the second embodiments principally by the construction of the pumping membrane and of the actuator device. Accordingly, components which are common to the three embodiments carry the same reference numerals and will not be described in more detail.

This third embodiment also includes a base plate 2 and the upper plate 8, provided respectively with an inflow conduit 10 and an outflow conduit 4. Between these two plates 2 and 8, there is sandwiched an intermediate plate 6 made of silicon machined by photolithographic techniques, to form an inlet valve 12, an outlet valve 28, and a pumping chamber 50. Thin layers of silicon oxide 26, 33, 34, 65 make it possible to introduce a predetermined amount of prestressing into the silicon membrane.

The pumping chamber is also of a circular shape and is connected by passages 52 and 54 to the inflow and outflow valves. The pumping membrane 256, which is machined in the silicon plate 6, is a movable wall of the pumping chamber having a thickness which is substantially uniform and has on its lower surface a stopper member 260, to limit the motion of the membrane during the expelling of the fluid. Preferably, this stopper member is formed as an area of a small size made of silicon or of silicon oxide. This member is located beneath the actuator device comprising the piezoelectric chip 270 bonded by welding or by an adhesive to the upper surface of the pumping membrane 256, while being connected via the connections 274, 276 to a generator 78 designed for supplying an alternating voltage.

An upper adjustable stopper member 258 designed for limiting the movement of the membrane during the suction consists of an annular part 261 inserted and bonded by an adhesive in a bore of the upper plate 8. This annular part 261 is provided with a threaded bore 263 capable of receiving a screw 265 which acts as a stopper having a height which can be adjusted to cooperate with the piezoelectric chip 270. The annular part 261 and the screw 265 are preferably made of a metal material.

Thus, the movement of the pumping membrane 256 is limited precisely upwards and downwards. Furthermore, it is possible to adjust the amplitude of this movement by acting on the screw 265. Accordingly, this construction makes it possible to pump a very precise amount of the product at each alternating movement of the pumping membrane, while authorizing a precise adjustment of the amount pumped. Variations or deteriorations of the performance of the piezoelectric chip within certain limits have no influence on the outflow of the micropump. An electrical contact 264 is provided on the metal screw 165 which makes it possible to control, together with the upper connection of the piezoelectric chip, the motion of the pumping membrane 256 during suction.

Advantageously, the screw 265 can be made of a material capable of compensating variations of the shape of the movable wall 256 due to temperature effects, since such variations without compensation can have an influence on the volume of the fluid being pumped. Such a compensation could also be obtained by virtue of the screws 90 described with reference to FIGS. 7.

The embodiments described are particularly well suited for the administration of medicinal drugs, and in particular as micropumps capable of being implanted in the body of a patient.

We claim:

1. A micropump including at least one base plate (2), at least one upper plate (8) and one intermediate plate (6) sandwiched between the two other plates (2, 8) and shaped so as to define a pumping chamber (50), at least one control member (12) for the inflow of the fluid to connect the pumping chamber with at least one inlet (10) to the micropump and at least one control member (38) for the outflow of the fluid to connect the pumping chamber (50) with at least one outlet (4) of the micropump, the pumping chamber (50) including a movable wall (56, 156, 256) which is machined in the intermediate plate (6) and which can be displaced in two opposite directions during the suction of a fluid from the inlet (10) to the pumping chamber (50) or during the expelling of this fluid from the pumping chamber to the outlet (4), actuating means (70, 170, 270) being provided to move said movable wall (56, 156, 256) to cause a periodical variation of the volume of the pumping chamber (50), characterized in that the micropump includes first and second stopper members arranged in such a manner as to limit the amplitude of the movement of the movable wall (56, 156, 256) in said two opposite directions, with the first stopper members (58, 62, 64; 158, 162, 164; 258, 270) limiting this movement during the sucking of the fluid inside the pumping chamber (50) and the second stopper members (2, 60; 2, 160; 2, 260) limiting this movement during the expelling of fluid from the pumping chamber (50).

2. A micropump according to claim 1, characterized in that a face of the movable wall (56) which is directed inwards of the pumping chamber (50) includes at least one protrusion (60, 160, 260) forming, with the base plate (2), the second stopper members limiting the movement during the expelling of the fluid.

3. A micropump according to claim 1, characterized in that the first stopper members are provided as at least one adjustable screw (90, 265) extending through the upper plate (8), each said at least one adjustable screw having one end positioned facing the movable wall (56, 256).

4. A micropump according to claim 3, characterized in that a piezoelectric member (270) is sandwiched between said end of the at least one adjustable screw (265) and the movable wall (256) and is bonded to this wall.

5. A micropump according to claim 3, characterized in that the at least one adjustable screw (90,265) is made of a material capable of compensating the variations in the shape of the movable wall (56, 256) due to the effects of temperature.

6. A micropump, including at least one base plate (2), at least one upper plate (8) and one intermediate plate (6) sandwiched between the two other plates (2, 8) and shaped so as to define a pumping chamber (50), at least one control member (12) for the inflow of the fluid to connect the pumping chamber with at least one inlet (10) to the micropump and at least one control member (38) for the outflow of the fluid to connect the pumping chamber (50) with at least one outlet (4) of the micropump, the pumping chamber (50) including a movable wall (56, 156, 256) which is machined in the intermediate plate (6) and which can be displaced in two opposite directions during the suction of a fluid from the inlet (10) to the pumping chamber (50) or during the expelling of this fluid from the pumping chamber to the outlet (4), actuating means (70, 170, 270) being provided to move said movable wall (56, 156, 256) to cause a periodical variation of the volume of the pumping chamber (50), wherein the micropump includes first and second stopper members arranged in such a manner as to limit the amplitude of the movement of the movable wall (56, 156, 256) in said two opposite directions, with the first stopper members (58, 62, 64; 158, 162, 164; 258, 270) limiting this movement during the sucking of the fluid inside the pumping chamber (50) and the second stopper members (2, 60; 2, 160; 2, 260) limiting this movement during the expelling of fluid from the pumping chamber (50).

wherein said micropump includes expulsion control electrodes (44, 46) placed one facing each other, one (44) of said expulsion control electrodes being mounted on one movable wall placed downstream of the pumping chamber (50), in such a manner as to control the expelling of the fluid from the micropump.

7. Use of a micropump according to claim 1 for the administration of medicinal drugs, the micropump being implanted into the body of a patient.

8. A micropump, including at least one base plate (2), at least one upper plate (8) and one intermediate plate (6)

sandwiched between the two other plates (2, 8) and shaped so as to define a pumping chamber (50), at least one control member (12) for the inflow of the fluid to connect the pumping chamber with at least one inlet (10) to the micropump and at least one control member (38) for the outflow of the fluid to connect the pumping chamber (50) with at least one outlet (4) of the micropump, the pumping chamber (50) including a movable wall (56, 156, 256) which is machined in the intermediate plate (6) and which can be displaced in two opposite directions during the suction of a fluid from the inlet (10) to the pumping chamber (50) or during the expelling of this fluid from the pumping chamber to the outlet (4), actuating means (70, 170, 270) being provided to move said movable wall (56, 156, 256) to cause a periodical variation of the volume of the pumping chamber (50), wherein the micropump includes first and second stopper members arranged in such a manner as to limit the amplitude of the movement of the movable wall (56, 156, 256) in said two opposite directions, with the first stopper members (58, 62, 64; 158, 162, 164; 258, 270) limiting this movement during the sucking of the fluid inside the pumping chamber (50) and the second stopper members (2, 60; 2, 160; 2, 260) limiting this movement during the expelling of fluid from the pumping chamber (50);

wherein the movable wall (56) includes a central rigid part (58) surrounded by a resilient edge (61) of a smaller thickness integral with the central rigid part (58), the central rigid part (58) protruding relatively with respect to a face of the movable wall (56) which is opposite to the pumping chamber (50) and being designed for coming in contact with the plate (2, 8) which is positioned facing the same for providing said first stopper members limiting the movement of the movable wall (56) during the sucking of the fluid.

9. A micropump according to claim 8, characterized in that a width of said central rigid part (58) represents between 20% and 90% of an overall width of the movable wall (56), and preferably between 50% and 80%.

10. A micropump including at least one base plate (2), at least one upper plate (8) and one intermediate plate (6) sandwiched between the two other plates (2, 8) and shaped so as to define a pumping chamber (50), at least one control member (12) for the inflow of the fluid to connect the pumping chamber with at least one inlet (10) to the micropump and at least one control member (38) for the outflow of the fluid to connect the pumping chamber (50) with at least one outlet (4) of the micropump, the pumping chamber (50) including a movable wall (56, 156, 256) which is machined in the intermediate plate (6) and which can be displaced in two opposite directions during the suction of a fluid from the inlet (10) to the pumping chamber (50) or during the expelling of this fluid from the pumping chamber to the outlet (4), actuating means (70, 170, 270) being provided to move said movable wall (56, 156, 256) to cause a periodical variation of the volume of the pumping chamber (50), wherein the micropump includes first and second stopper members arranged in such a manner as to limit the amplitude of the movement of the movable wall (56, 156, 256) in said two opposite directions, with the first stopper members (58, 62, 64; 158, 162, 164; 258, 270) limiting this movement during the sucking of the fluid inside the pumping chamber (50) and the second stopper members (2, 60; 2, 160; 2, 260) limiting this movement during the expelling of fluid from the pumping chamber (50);

wherein the actuator means (70) include a driving member (72) mounted movably on either the base plate or the upper plate (2, 8) and an intermediate part (84) placed between the movable wall (56) and the driving member (72).

11. A micropump according to claim 10, characterized in that the driving member (72) is mounted movably on a outer face of said upper plate (8), said intermediate part (84) extending through the upper plate (8) via an opening (89).

12. A micropump according to claim 11, characterized in that the driving member is a piezoelectric member (72, 80) which is mounted via a spacer member (82) on the outer face of the upper plate (8).

13. A micropump according to claim 11, characterized in that the intermediate part (84) includes a flat head (86) integral with the piezoelectric member (72, 80) and a rod (88) extending through the upper plate (8) and acting by its end on the movable wall (56).

14. A micropump, including at least one base plate (2), at least one upper plate (8) and one intermediate plate (6) sandwiched between the two other plates (2, 8) and shaped so as to define a pumping chamber (50), at least one control member (12) for the inflow of the fluid to connect the pumping chamber with at least one inlet (10) to the micropump and at least one control member (38) for the outflow of the fluid to connect the pumping chamber (50) with at least one outlet (4) of the micropump the pumping chamber (50) including a movable wall (56, 156, 256) which is machined in the intermediate plate (6) and which can be displaced in two opposite directions during the suction of a fluid from the inlet (10) to the pumping chamber (50) or during the excelling of this fluid from the pumping chamber to the outlet (4), actuating means (70, 170, 270) being provided to move said movable wall (56, 156, 256) to cause a periodical variation of the volume of the pumping chamber (50), wherein the micropump includes first and second stopper members arranged in such a manner as to limit the amplitude of the movement of the movable wall (56, 156, 256) in said two opposite directions, with the first stopper members (58, 62, 64; 158, 162, 164; 258, 270) limiting this movement during the sucking of the fluid inside the pumping chamber (50) and the second stopper members (2, 60; 2, 160; 2, 260) limiting this movement during the expelling of fluid from the pumping chamber (50);

wherein said micropump includes electrodes (62, 64; 162, 164; 262, 264) placed facing each other on the movable wall (56; 156; 256) and on the upper plate (8), these electrodes being connected to a circuit which makes it possible to control the functioning of the deformable wall (56; 156; 256).

15. A micropump, including at least one base plate (2), at least one upper plate (8) and one intermediate plate (6) sandwiched between the two other plates (2, 8) and shaped so as to define a pumping chamber (50), at least one control member (12) for the inflow of the fluid to connect the pumping chamber with at least one inlet (10) to the micropump and at least one control member (38) for the outflow of the fluid to connect the pumping chamber (50) with at least one outlet (4) of the micropump, the pumping chamber (50) including a movable wall (56, 156, 256) which is machined in the intermediate plate (6) and which can be displaced in two opposite directions during the suction of a fluid from the inlet (10) to the pumping chamber (50) or during the expelling of this fluid from the pumping chamber to the outlet (4), actuating means (70, 170, 270) being provided to move said movable wall (56, 156, 256) to cause a periodical variation of the volume of the pumping chamber (50), wherein the micropump includes first and second stopper members arranged in such a manner as to limit the amplitude of the movement of the movable wall (56, 156, 256) in said two opposite directions, with the first stopper members (58, 62, 64; 158, 162, 164; 258, 270) limiting this movement during the sucking of the fluid inside the pumping chamber (50) and the second stopper members (2, 60; 2, 160; 2, 260) limiting this movement during the expelling of fluid from the pumping chamber (50);

wherein the movable wall (156) consists of a membrane exhibiting a central part (158) protruding in such a manner as to provide with the upper plate (8) said first stopper members, this central part being surrounded by a piezoelectric member (172) bonded to the membrane and exhibiting a first central bore (173) for the passage of the central part (158).

* * * * *